US008985225B2

(12) United States Patent
Nikiforuk

(10) Patent No.: US 8,985,225 B2
(45) Date of Patent: Mar. 24, 2015

(54) TUBULAR ENGAGING DEVICE AND METHOD

(75) Inventor: Kevin James Nikiforuk, Houston, TX (US)

(73) Assignee: Tesco Corporation, Houston, TX (US)

( * ) Notice: Subject to any disclaimer, the term of this patent is extended or adjusted under 35 U.S.C. 154(b) by 500 days.

(21) Appl. No.: 13/329,069

(22) Filed: Dec. 16, 2011

(65) Prior Publication Data

US 2013/0153244 A1 Jun. 20, 2013

(51) Int. Cl.
*E21B 19/16* (2006.01)

(52) U.S. Cl.
CPC ..... *E21B 19/16* (2013.01)
USPC ..... 166/379; 166/77.51; 166/85.1

(58) Field of Classification Search
CPC ..... E21B 19/06
USPC ..... 166/77.51, 85.1, 379; 175/162; 294/102.2, 86.12; 81/57.33
See application file for complete search history.

(56) References Cited

U.S. PATENT DOCUMENTS 4,762,187 A * 8/1988 Haney ..... 175/171
4,821,814 A * 4/1989 Willis et al. ..... 173/164
6,311,792 B1 11/2001 Scott et al.
6,668,684 B2 * 12/2003 Allen et al. ..... 81/57.15
7,140,443 B2 11/2006 Beierbach et al.
7,377,324 B2 5/2008 Beierbach et al.
7,752,945 B2 7/2010 Bouligny, Jr.
7,770,654 B2 8/2010 Beierbach et al.
7,793,729 B2 9/2010 Nikiforuk
8,042,626 B2 10/2011 Slack
8,074,711 B2 12/2011 Ellis et al.
8,230,933 B2 7/2012 Snider et al.
2005/0188793 A1 * 9/2005 Cherry ..... 81/57.33
2007/0131416 A1 * 6/2007 Odell et al. ..... 166/250.1
2009/0065223 A1 * 3/2009 Bouligny, Jr. ..... 173/1
2009/0095489 A1 4/2009 Roodenburg et al.
2011/0114308 A1 5/2011 Nikiforuk et al.
2011/0132594 A1 * 6/2011 Slack ..... 166/77.51
2011/0259577 A1 * 10/2011 Hughes et al. ..... 166/77.53

OTHER PUBLICATIONS

PCT International Search Report & Written Opinion for International Applicaiton No. PCT/US2012/068022 mailed Dec. 20, 2013.

* cited by examiner

*Primary Examiner* — Shane Bomar
*Assistant Examiner* — Steven MacDonald
(74) *Attorney, Agent, or Firm* — Fletcher Yoder, P.C.

(57) ABSTRACT

Present embodiments are directed to a device for a top drive drilling system. The device includes a movable sleeve configured to be disposed around at least a portion of a sub. The movable sleeve is configured to be selectively disposed around a tubular by sliding axially along the sub. The device also includes a plurality of engagement features extending inwardly from an inner circumference of the movable sleeve. When the movable sleeve is disposed around the tubular, the plurality of engagement features are configured to engage the tubular when the movable sleeve is rotated in a first direction and to not engage the tubular when the movable sleeve is rotated in a second direction.

18 Claims, 4 Drawing Sheets

TUBULAR ENGAGING DEVICE AND METHOD

BACKGROUND

The present disclosure relates generally to the field of drilling and processing of wells, and, more particularly, to a tubular engaging device and method for using the tubular engaging device.

In conventional oil and gas operations, a well is typically drilled to a desired depth with a drill string, which includes drillpipe, drill collars and a bottom hole drilling assembly. The drill string may be turned by a rotary table and kelly assembly or by a top drive. A top drive typically includes a quill, which is a short length of pipe that couples with the upper end of the drill string, and one or more motors configured to turn the quill. The top drive is typically suspended from a traveling block above the rig floor so that it may be raised and lowered throughout drilling operations.

In conventional operations, to add a length of tubular (e.g., drillpipe or drill collar) to the drill string, an elevator is coupled with the tubular to facilitate hoisting the tubular from the rig floor. The tubular is aligned with the drill string and lowered onto the drill string. An iron roughneck at the rig floor may be used to rotate the tubular and attach the tubular to the drill string. However, it is now recognized that using an iron roughneck to add each new length of tubular to the drill string may be time consuming and expensive. Accordingly, it is now recognized that there exists a need for a device and method for connecting tubulars to drill strings without the use of an iron roughneck.

BRIEF DESCRIPTION

In accordance with one aspect of the present disclosure, a device for a top drive drilling system includes a sub having a first coupling end configured to mate with the top drive drilling system and a second coupling end configured to mate with a tubular. The device also includes a movable sleeve disposed around at least a portion of the sub. The movable sleeve is configured to be selectively disposed around the tubular by sliding axially along the sub. The device includes a plurality of engagement features extending inwardly from an inner circumference of the movable sleeve. When the movable sleeve is disposed around the tubular, the plurality of engagement features are configured to engage the tubular when the movable sleeve is rotated in a first direction and to not engage the tubular when the movable sleeve is rotated in a second direction.

In accordance with another aspect of the disclosure, a device for a top drive drilling system includes a movable sleeve configured to be disposed around at least a portion of a sub. The movable sleeve is configured to be selectively disposed around a tubular by sliding axially along the sub. The device also includes a plurality of engagement features extending inwardly from an inner circumference of the movable sleeve. When the movable sleeve is disposed around the tubular, the plurality of engagement features are configured to engage the tubular when the movable sleeve is rotated in a first direction and to not engage the tubular when the movable sleeve is rotated in a second direction.

Present embodiments also provide a method for coordinating tubulars in a top drive drilling system. In one embodiment, the method includes sliding a movable sleeve axially along a sub. The method also includes disposing a plurality of engagement features around a tubular. The plurality of engagement features extend inwardly from an inner circumference of the movable sleeve. The method includes rotating the plurality of engagement features around the tubular in a first direction. The method also includes engaging the plurality of engagement features with the tubular to cause the plurality of engagement features to apply a frictional force to the tubular. The frictional force is configured to cause the tubular to rotate in the first direction.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure provides a novel coupling device for a top drive drilling system and a method that can be used in drilling operations. The presently disclosed techniques allow for tubulars to be coordinated (e.g., assembled, disassembled, etc.) using a top drive having the coupling device attached to the top drive. Further, the tubulars may be coordinated using power from the top drive without the use of an iron roughneck. The coupling device may include a movable sleeve disposed around a portion of a sub. During operation, the sub is coupled to the top drive (e.g., to the quill of the top drive) and the sub may interlock or otherwise engage the movable sleeve to translate motion from the top drive via the sub to the movable sleeve. Engagement features extend inwardly from the movable sleeve and may be engaged with a tubular by extending a portion of the movable sleeve over the tubular and rotating the movable sleeve (e.g., using the top drive to rotate the coupling device) and thereby rotating the engagement features around the tubular. When the engagement features are engaged with the tubular, the engagement features may provide sufficient torque to rotate the tubular to attach the tubular to a drill string or to detach the tubular from the drill string.

Figure 1:
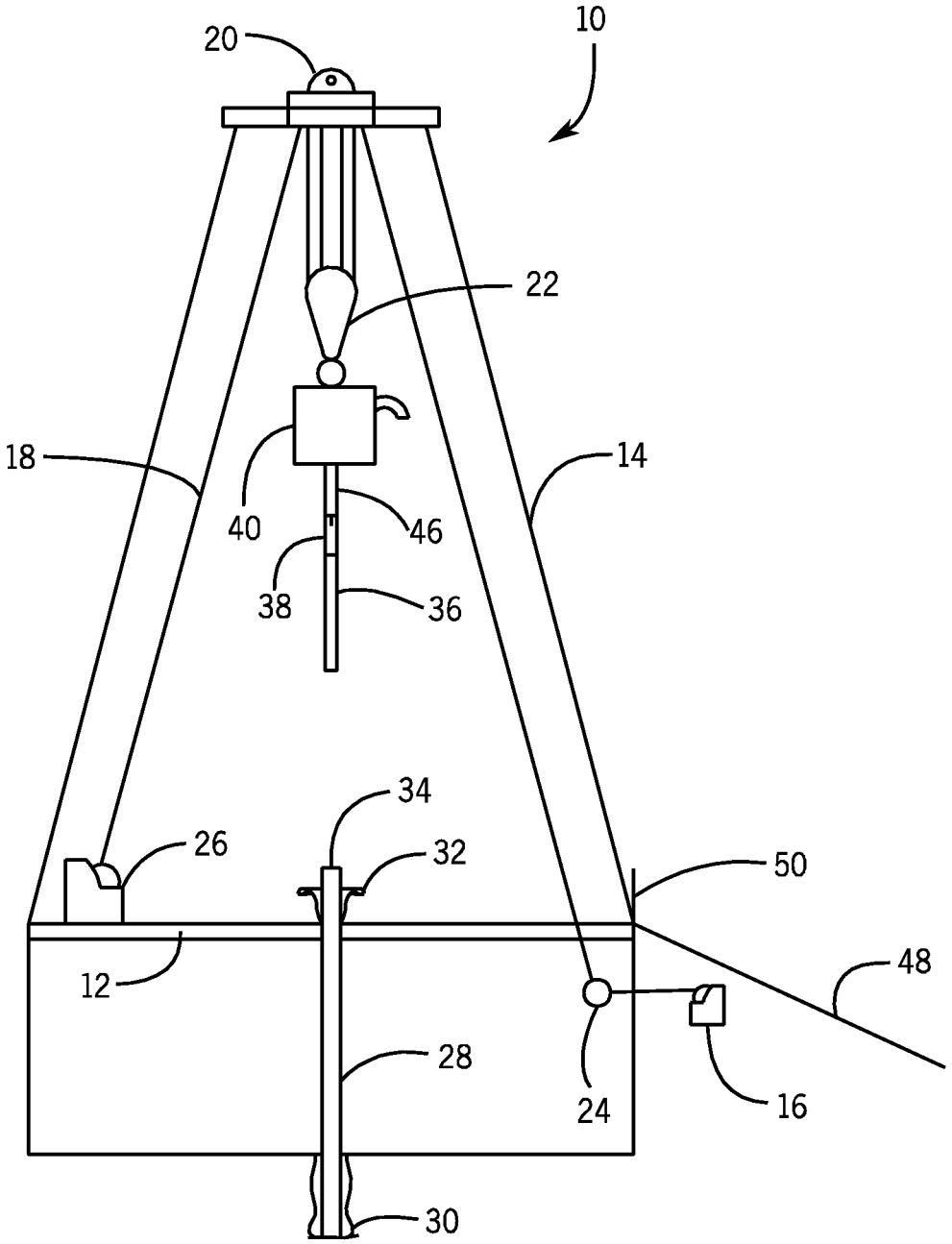
FIG. 1 is a schematic representation of a well being drilled in accordance with present techniques.

Turning now to the drawings, FIG. 1 is a schematic of a drilling rig 10 in the process of drilling a well in accordance with present techniques. The drilling rig 10 includes an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 using slips 32. A portion of the drill string 28 extends above the rig floor 12, forming a stump 34 to which another length of tubular 36 may be added. In certain embodiments, the tubular 36 may be coupled to a sub assembly 38 in accordance with present embodiments, and the sub assembly 38 may be coupled to a top drive drilling system 40. In particular, the sub assembly 38 may be coupled to a quill 46 of the top drive drilling system 40. The top drive drilling system 40, hoisted by the traveling block 22, positions the tubular 36 above the wellbore before coupling the tubular 36 with the drill string 28. The top drive drilling system 40, once coupled with the tubular 36, may then lower the coupled tubular 36 toward the stump 34 and rotate the tubular 36 such that it connects with the stump 36 and becomes part of the drill string 28.

In certain embodiments, the top drive drilling system 40 may include elevators for positioning the tubular 36 over the drill string 28 and coupling the tubular 36 with other features. For example, the elevators may be used to hoist the tubular 36 up a pipe ramp 48 and through a V-door 50 to a position over the drill string 28. After the tubular 36 is positioned over the drill string 28, the sub assembly 38 may be used to couple the tubular 36 to the drill string 28. Further, the sub assembly 38 may be used to decouple the tubular 36 from the drill string 28 after it has previously been coupled to the drill string 28. The sub assembly 38 may include engagement features that apply a torque to the tubular 36 when the sub assembly 38 is rotated in a first direction. The torque may be applied to the tubular 36 by the engagement features gripping the tubular 36 and causing a rotational force to be transferred from the top drive drilling system 40 to the tubular 36 when the sub assembly 38 is rotated in the first direction. When the sub assembly 38 is rotated in a second direction, the engagement features do not engage the tubular 36. For example, the engagement features may slip, or no longer grip the tubular 36.

To couple the tubular 36 to the drill string 28, a sleeve of the sub assembly 38 may be lowered around the upper end of the tubular 36. Thereafter, the sub assembly 38 is rotated in the first direction until the tubular 36 is coupled to the drill string 28. As will be appreciated, while the sub assembly 38 is applying rotational force to the tubular 36, the slips 32 are used to hold the drill string 28 in place and to keep the drill string 28 from rotating. After the tubular 36 is coupled to the drill string 28, the sub assembly 38 is rotated in the second direction to disengage the engagement features from the tubular 36. The sub assembly 38 may be raised off of the upper end of the tubular 36 after the tubular 36 is coupled to the drill string 28. Thus, the tubular 36 may be added to the drill string 28 using power from the top drive drilling system 40 without using an iron roughneck.

It should be noted that the illustration of FIG. 1 is intentionally simplified to focus on the sub assembly 38 coupled to the top drive drilling system 40, which is described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
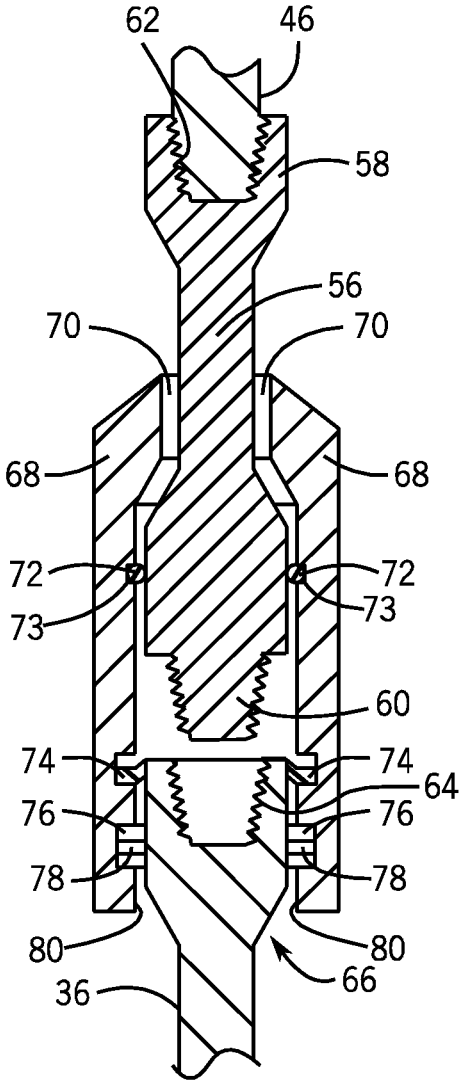
FIG. 2 is a schematic cross-sectional view of an embodiment of a sub assembly coupled with a top drive drilling system for coordinating tubulars in accordance with present techniques.

FIG. 2 is a schematic cross-sectional view of an embodiment of the sub assembly 38 coupled with the top drive drilling system 40 for coordinating tubulars. The sub assembly 38 includes a sub 56 having a first coupling end 58 and a second coupling end 60. In certain embodiments, the first coupling end 58 may include threads to couple the first coupling end 58 to a threaded coupling end 62 of the quill 46. In other embodiments, the sub 56 may be configured to be coupled to the quill 46, or another part of the top drive drilling system 40, in another manner (e.g., using a clamp, bolt, etc). The second coupling end 60 may also include threads to couple the second coupling end 60 to a threaded coupling end 64 of the tubular 36 when such a coupling is desired (e.g., to transfer fluids). Again, as will be appreciated, in other embodiments, the sub 56 may be configured to be coupled to the tubular 36 in another manner. As illustrated, the coupling end 64 of the tubular 36 may be part of a tool joint 66.

The sub assembly 38 also includes a movable sleeve 68 disposed around a portion of the sub 56. The movable sleeve 68 includes one or more splines 70 that slidably engage one or more grooves in the sub 56. The splines 70 allow the movable sleeve 68 to move axially along the sub 56 and allow for transfer of motion from the sub 56 to the movable sleeve 68. For example, the movable sleeve 68 may use the splines 70 to slide between the first coupling end 58 and the second coupling end 60. As such, the movable sleeve 68 may be selectively disposed around the tool joint 66 of the tubular 36 and a portion of the sub 56, simply around the sub 56, or any of various different devices. In certain embodiments, the movable sleeve 68 may be positioned manually, while in other embodiments the movable sleeve 68 may be positioned using automation features that will be described in more detail below in relation to FIG. 4. As will be appreciated, the sub 56 and/or the movable sleeve 68 may include a braking portion, locking device, or another mechanism to hold the movable sleeve 68 at a desired position.

In the illustrated embodiment, a first sealing device 72 (e.g., o-ring, gasket, etc) is disposed between the sub 56 and the movable sleeve 68. As illustrated, the first sealing device 72 may be disposed between the second coupling end 60 of the sub 56 and the movable sleeve 68. In certain embodiments, the first sealing device 72 may disposed in a circumferential groove 73 in the movable sleeve 68 to hold the first sealing device 72 in place. In other embodiments, the first sealing device 72 may be disposed in a groove in the coupling end 60 to hold the first sealing device 72 in place. A second sealing device 74 (e.g., o-ring, gasket, etc) is disposed within a lower portion of the movable sleeve 68 and is used to provide a seal between the movable sleeve 68 and the tubular 36 when the movable sleeve 68 is disposed around the tubular 36. As such, the first sealing device 72 and the second sealing device 74 may be used together to provide a pressure seal (e.g., for pumping mud through the sub 56 and into the tubular 36).

The movable sleeve 68 includes an engagement assembly 76 with engagement features 78 (e.g., sprag elements, cam-like features, or gripping elements) extending inwardly from an inner circumference 80 of the movable sleeve 68. When the movable sleeve 68 is disposed around the tubular 36, the engagement features 78 of the engagement assembly 76 are arranged to engage the tubular 36 (e.g., grip the tubular 36) when rotated in a first direction and to not engage the tubular 36 (e.g., slip over the surface of the tubular 36), or to disengage the tubular 36 (e.g., no longer grip the tubular 36 if previously gripped), when rotated in a second direction. For example, the engagement features 78 may apply a frictional rotation force or torque to the tubular 36 when the engagement assembly 76 is rotated in the first direction to grip the tubular 36. When the engagement assembly 76 is rotated in the second direction, the engagement features 78 may slip, or no longer grip the tubular 36. When frictional force is applied, the applied frictional force may be used to rotate the tubular 36, such as for connecting the tubular 36 to the drill string 28 or disconnecting the tubular 36 from the drill string 28. As will be appreciated, the engagement assembly 76 may be rotated by rotating the sub assembly 38. Further, the top drive drilling assembly 40 may be used to rotate the sub assembly 38. In certain embodiments, the engagement assembly 76, the engagement features 78, or a subset of the engagement features 78 may be reversible so that the engagement features 78 engage the tubular 36 when rotated in the second direction and do not engage the tubular 36 when rotated in the first direction.

Figure 3:
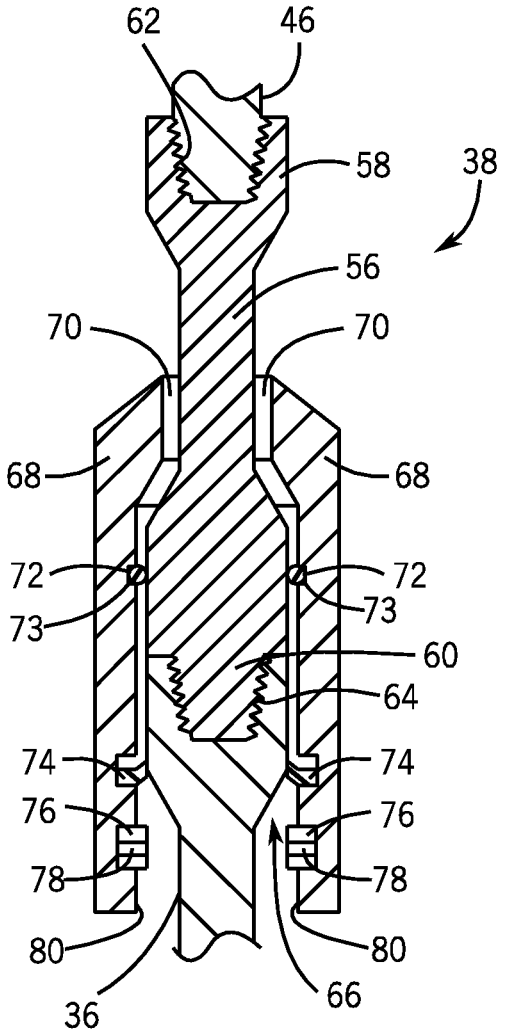
FIG. 3 is a schematic cross-sectional view of the embodiment of the sub assembly of FIG. 2 with a tubular coupled to the sub assembly in accordance with present techniques.

As illustrated in FIG. 2, the engagement features 78 engage the tubular 36 when the coupling end 64 of the tubular 36 is not coupled to the second coupling end 60 of the sub 56. However, as previously discussed, the coupling end 64 of the tubular 36 may be coupled to the second coupling end 60 of the sub 56, as illustrated in FIG. 3. In such a configuration, the engagement features 78 may not engage the tubular 36. For example, in the illustrated embodiment, the engagement features 78 are located beyond the tool joint 66 and are not of sufficient length to engage the tubular 36. Further, with the tubular 36 coupled to the sub 56, the top drive drilling system 40 may be used for standard drilling operations such as for pumping pressurized mud into the tubular 36, raising or lowering the tubular 36, raising or lowering the drill string 28, rotation of the tubular 36 or drill string 38, or for any other suitable purpose.

Figure 4:
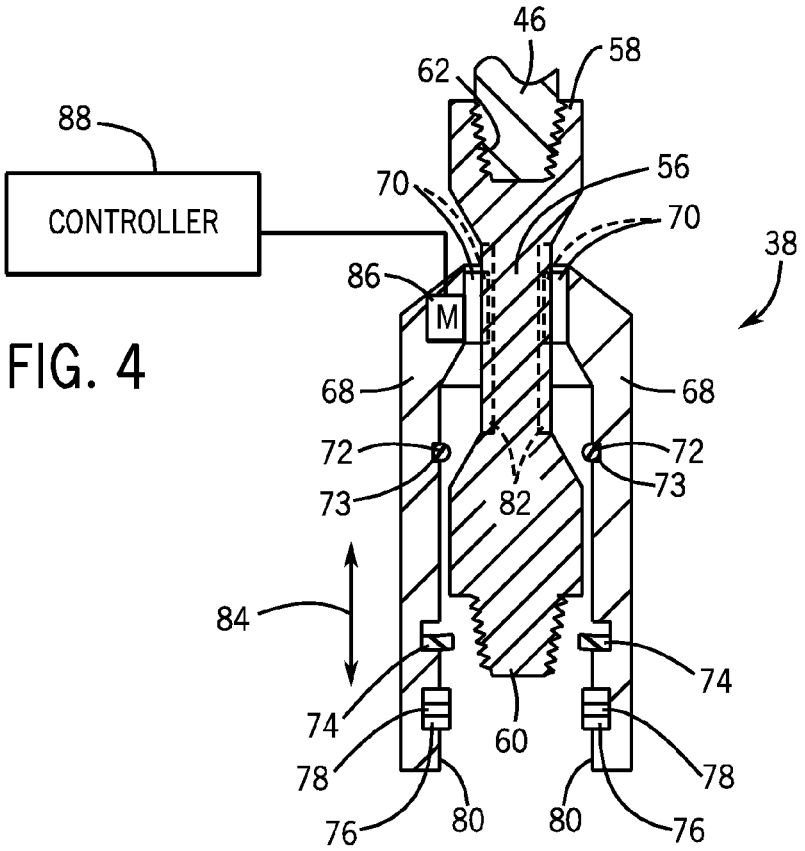
FIG. 4 is a schematic cross-sectional view of an embodiment of a sub assembly with an automated movable sleeve coupled with a top drive drilling system for coordinating tubulars in accordance with present techniques.

FIG. 4 is a schematic cross-sectional view of an embodiment of the sub assembly 38 with a automated movable sleeve 68 coupled with the top drive drilling system 40 for coordinating tubulars. The movable sleeve 68 may include one or more splines 70 as previously described. The splines 70 are configured to slidably engage one or more axial grooves 82 in the sub 56. The arrangement of the splines 70 and the grooves 82 allows the movable sleeve 68 to move axially 84 along the sub assembly 38 while facilitating translation of rotational force. Although the splines 70 and grooves 82 are presented as extending in the axial direction 84, in certain embodiments, the splines 70 and grooves 82 may extend in a different direction, such as a circumferential direction 85. For example, the movable sleeve 68 may be selectively disposed around a portion of the sub 56 using a thread-like coupling that couples the movable sleeve 68 to the sub 56. In such a configuration, the movable sleeve 68 may be rotated around the sub 56 to change the position of the movable sleeve 68. Further, the movable sleeve 68 and/or the sub 56 may include a locking feature to hold the movable sleeve 68 in a fixed position relative to the sub 56.

As illustrated, the sub assembly 38 may include a motor 86 to axially slide the movable sleeve 68. Further, a controller 88 may be electrically and/or communicatively coupled to the motor 86. Thus, the controller 88 may send control signals and/or power signals to the motor 86 to cause the motor 86 to slide the movable sleeve 68. By using the motor 86 the movable sleeve 68 may slide to a number of positions without an operator manually positioning the movable sleeve 68. As will be appreciated, in certain embodiments, an actuator or other device may be used instead of the motor 86 to slide the movable sleeve 68.

Figure 5:
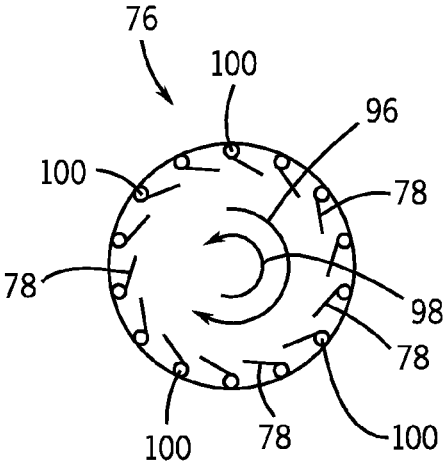
FIG. 5 is a schematic top view of an embodiment of an engagement assembly used to engage a tubular when rotated in a first direction in accordance with present techniques.

FIG. 5 is a schematic top view of an embodiment of the engagement assembly 76 having engagement elements 78 used to engage the tubular 36 when rotated in a first direction 96. The engagement elements 78 are arranged circumferentially around the engagement assembly 76 to enable engagement of the engagement assembly 76 with the exterior of the tubular 36. Although the engagement elements 78 are illustrated as being generally straight, the engagement elements 78 may be curved, hooked, crescent shaped, or any other suitable shape. Specifically, the engagement elements 78 may be shaped to facilitate frictional engagement of the tubular 36 when turned in the first direction 96 and slippage when turned in a second direction 98 (i.e., opposite the first direction 96). Further, the engagement elements 78 may be constructed using steel, or any other suitable material such as a polymeric composition, metal, metal alloy, and so forth. The engagement elements 78 are arranged so that when the engagement assembly 76 is rotated in the first direction 96, the engagement elements 78 will engage a tubular 36 disposed within the engagement assembly 76. For example, when the engagement elements 78 rotate, the surface of the engagement elements 78 contacts the surface of the tubular 36. The engagement elements 78 then grip, or press inwardly against, the tubular 36 and apply torque to the tubular 36. As the engagement assembly 76 is further rotated in the first direction 96, the engagement elements 78 apply sufficient torque to cause the tubular 36 to rotate in the first direction 96.

Conversely, the engagement assembly 76 may be rotated in the second direction 98. When the engagement assembly 76 is rotated in the second direction 98, the engagement elements 78 may slide around the tubular 36 without applying a sufficient frictional force to rotate the tubular 36. Further, if the engagement elements 78 were previously engaged with the tubular 36, rotating the engagement assembly 76 in the second direction 98 may disengage the engagement elements 78 from the tubular 36.

As illustrated, the engagement elements 78 may be coupled to the engagement assembly 76 using hinges 100. The hinges 100 provide a rotational axis for the engagement elements 78. As will be appreciated, the hinges 100 may be formed to limit the range of movement of the engagement elements 78 in a particular direction, which may assist with engagement based on rotational direction. In certain embodiments, the engagement elements 78 may include geometric characteristics (e.g., generally straight, curved, etc.) and coupling features (e.g., hinges) that enable them to be reversed. For example, the engagement elements 78 may be reversed as shown in FIG. 6.

Figure 6:
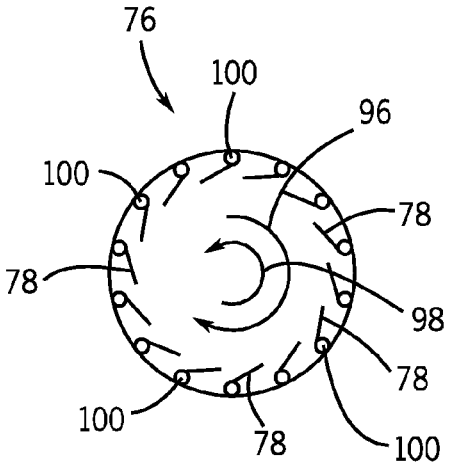
FIG. 6 is a schematic top view of an embodiment of an engagement assembly used to engage a tubular when rotated in a second direction in accordance with present techniques.

FIG. 6 is a schematic top view of an embodiment of the engagement assembly 76 used to engage the tubular 36 when rotated in the second direction 98 and to not engage the tubular 36, or to disengage with the tubular 36, when rotated in the first direction 96. As may be appreciated, the engagement assembly 76 and/or the engagement elements 78 may be reversed using a variety of methods. For example, in certain embodiments, the engagement assembly 76 may be removed from the movable sleeve 68, turned over, and reinserted into the movable sleeve 68. In other embodiments, the engagement elements 78 may be moved between the position illustrated in FIG. 5 and the position illustrated in FIG. 6. Further, in some embodiments, each engagement element 78 may be removed from the engagement assembly 76, reversed (e.g., by turning or flipping over), and reinserted into the engagement assembly 76. In such configurations, the hinges 100 may be removed while reconfiguring the engagement elements 78. It should be noted, that while the engagement assembly 76 and/or the engagement elements 78 may be reversible, certain embodiments may use two separate engagement assemblies 76 (e.g., one engagement assembly 76 as illustrated in FIG. 5 for providing torque in the first direction 96, and another engagement assembly 76 as illustrated in FIG. 6 for providing torque in the second direction 98).

Figure 7:
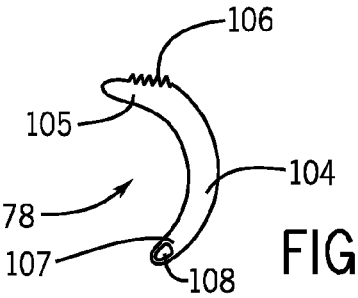
FIG. 7 is a schematic top view of an embodiment of an engagement feature in accordance with present techniques.

FIG. 7 is a schematic top view of an embodiment of the engagement feature 78 having a generally crescent shape. The engagement feature 78 includes a body portion 104 with an engagement end 105. The engagement end 105 is the portion of the engagement feature 78 that generally engages the tubular 36. The engagement end 105 may include teeth or wickers 106 that facilitate frictional engagement of the engagement feature 78 with the tubular 36 (e.g., to grip the tubular 36). The engagement feature 78 may also include an attachment end 107 used to attach the engagement feature 78 to the engagement assembly 76. The attachment end 107 includes an opening 108 where a hinge or mounting pin may be inserted during assembly to attach the engagement feature 78 to the engagement assembly 76.

Figure 8:
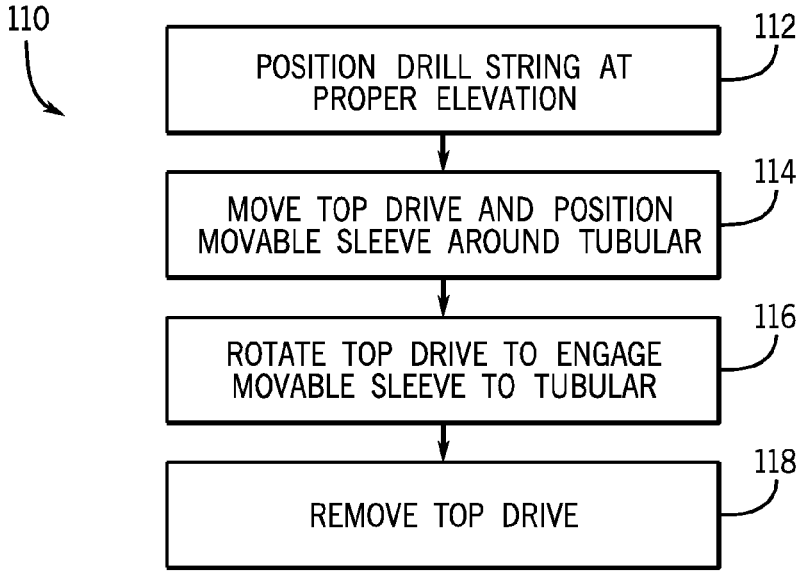
FIG. 8 is flow chart of an embodiment of a method for coordinating tubulars with a top drive drilling system in accordance with present techniques.

FIG. 8 is flow chart of an embodiment of a method 110 for coordinating tubulars with the top drive drilling system 40. As will be appreciated, the sub assembly 38 may be used for tripping tubulars 36 (e.g., drillpipe, drill collar, etc.) in or out of the wellbore 30, reaming in or out of the wellbore 30, or for other drilling operations. Each of these operations may be performed without using an iron roughneck. As such, the sub assembly 38 may perform tripping more efficiently than systems using an iron roughneck.

During a tripping out sequence using the sub assembly 38, the drill string 28 and the tubular 36 are positioned at a proper elevation, at block 112. For example, the elevator of the top drive drilling system 40 may close around the stump 34 of the drill string 28. The slips 32 are released to allow the drill string 28 to be moved. The elevator pulls the drill string 28 to the proper elevation and the slips 32 are applied to hold the drill string 28 in place. At block 114, the top drive drilling system 40 is lowered to set the slips 32 and the movable sleeve 68 of the sub assembly 38 is lowered to position the engagement assembly 76 around the tool joint 66 of the uppermost tubular 36. Then, at block 116, the top drive drilling system 40 is rotated to cause the engagement assembly 76 of the movable sleeve 68 to engage the tubular 36. In certain embodiments, the top drive drilling system 40 will rotate in a reverse, counter-clockwise, or second direction 98 to engage the engagement assembly 76 with the tubular 36. As will be appreciated, the engagement features 78 may be arranged as illustrated in FIG. 6 to engage the tubular 36 in the second direction 98. The top drive drilling system 40 is rotated until a bottom tool joint of the tubular 36 is disconnected from the drill string 28. In some embodiments, the top drive drilling system 40 will rotate in a forward, clockwise, or first direction 96 to disengage the engagement assembly 76 from the tubular 36. Next, at block 118, the top drive drilling system 40 is raised to remove the movable sleeve 68 from surrounding the tool joint 66 of the tubular 36. In certain embodiments, the movable sleeve 68 is moved from surrounding the tool joint 66 using the motor 86. The elevator then moves the tubular 36 so that it can be racked. To continue the tripping out sequence, blocks 112 through 118 may be repeated.

A tripping in sequence also uses the sub assembly 38 and may be performed in a similar manner to the tripping out sequence. Specifically, the drill string 28 is positioned at a proper elevation, at block 112. For example, the elevator of the top drive drilling system 40 opens from being around the stump 34 of the drill string 28. The top drive drilling system 40 is raised up to an elevation where the tubular 36 may be thrown in. The elevator closes around the tubular 36 and positions the tubular 36 within the stump 34 (e.g., stabs the tubular 36 into the stump 34). At block 114, the top drive drilling system 40 is lowered causing the movable sleeve 68 of the sub assembly 38 to position the engagement assembly 76 around the tool joint 66 of the tubular 36. Then, at block 116, the top drive drilling system 40 is rotated to cause the engagement assembly 76 of the movable sleeve 68 to engage the tubular 36. In certain embodiments, the top drive drilling system 40 will rotate in the forward, clockwise, or first direction 96 to engage the engagement assembly 76 with the tubular 36. As will be appreciated, the engagement features 78 may be arranged as illustrated in FIG. 5 to engage the tubular 36 in the first direction 96. The top drive drilling system 40 is rotated until a bottom tool joint of the tubular 36 is connected to the drill string 28 at an appropriate torque. In some embodiments, the top drive drilling system 40 will rotate in the reverse, counter-clockwise, or second direction 98 to disengage the engagement assembly 76 from the tubular 36. Next, at block 118, the top drive drilling system 40 is raised to remove the movable sleeve 68 from surrounding the tool joint 66 of the tubular 36. Again, in certain embodiments, the movable sleeve 68 is moved from surrounding the tool joint 66 using the motor 86. The elevators catch the tubular 36 and raise the drill string 28. Further, the slips 32 are removed, the drill string 28 is lowered to the appropriate elevation for the stump 34, and the slips 32 are applied. To continue the tripping in sequence, blocks 112 through 118 may be repeated.

In one embodiment, during operation of the top drive drilling system 40 with the sub assembly 38 attached, the movable sleeve 68 may be raised so that the engagement assembly 76 will not surround the tool joint 66 of the tubular 36. The top drive drilling system 40 is rotated in the forward, or first direction 96, then lowered onto the tool joint 66. This causes the second coupling end 60 of the sub 56 to engage with the coupling end 64 of the tubular 36. After the connection between the sub 56 and the tubular 36 is made up, drilling operations may be performed. Thus, using the sub assembly 38, tripping in, tripping out, and drilling operations may be performed, without the use of an iron roughneck.

Figure 9:
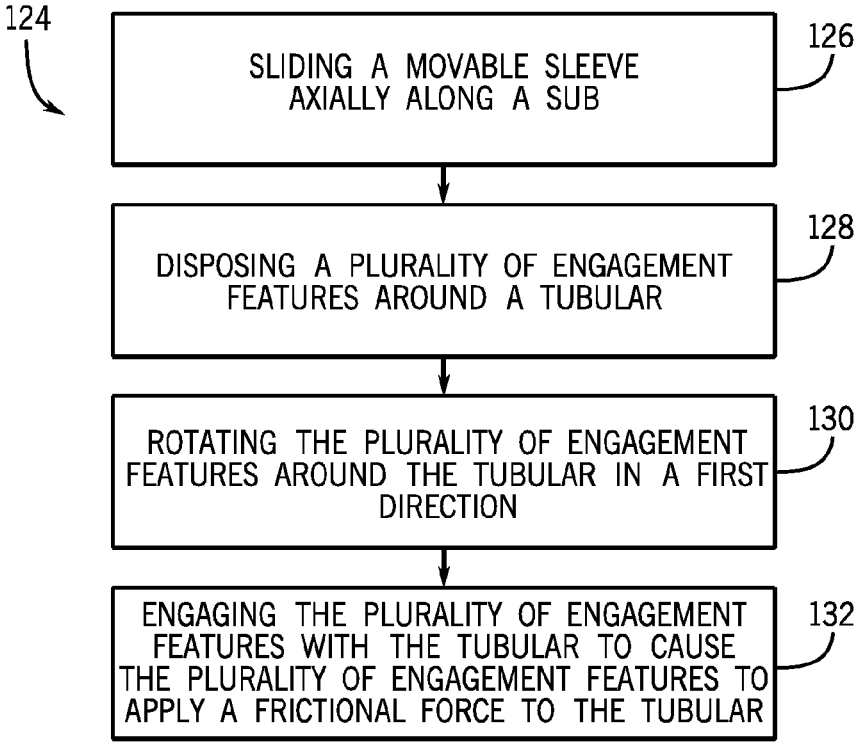
FIG. 9 is a flow chart of another embodiment of a method for coordinating tubulars with a top drive drilling system in accordance with present techniques.

FIG. 9 is a flow chart of another embodiment of a method 124 for coordinating tubulars with the top drive drilling system 40. At block 126, the movable sleeve 68 may slide axially 84 along the sub 56. Then, at block 128, the engagement features 78 may be disposed around the tubular 36. The engagement features 78 extend inwardly from the inner circumference 78 of the movable sleeve 68. Next, at block 130, the engagement features 78 are rotated around the tubular 36 in the first direction 96. At block 132, the plurality of engagement features 78 engage with the tubular 36 to cause the engagement features 78 to apply a frictional force to the tubular 36. The frictional force causes the tubular 36 to rotate in the first direction 96. In certain embodiments, the engagement features 78 may be disengaged from the tubular 36 to cause the engagement features 78 to discontinue applying the frictional force to the tubular 36 (e.g., such as by rotating the engagement features 78 in the second direction 98). Further, in some embodiments, the movable sleeve 68 may slide axially 84 along the sub 56 to move the engagement features 78 from being disposed around the tubular 36 (e.g., to move the movable sleeve 68 to not be disposed around the tubular 36).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A device for a top drive drilling system comprising:

a sub having a first coupling end configured to mate with the top drive drilling system and a second coupling end configured to mate with a tubular;

a movable sleeve disposed around at least a portion of the sub, the movable sleeve configured to be selectively disposed around the tubular by sliding axially along the sub;

a sealing device disposed between the movable sleeve and the sub; and a plurality of engagement features extending inwardly from an inner circumference of the movable sleeve, wherein, when the movable sleeve is disposed around the tubular, the plurality of engagement features are configured to engage the tubular when the movable sleeve is rotated in a first direction and to not engage the tubular when the movable sleeve is rotated in a second direction.

2. The device of claim 1, wherein the sealing device comprises an o-ring.

3. The device of claim 1, wherein at least a subset of the plurality of engagement features include geometric characteristics and coupling features configured to be reversible.

4. The device of claim 3, wherein reversing the subset of the plurality of engagement features causes the subset of the plurality of engagement features to engage the tubular when the movable sleeve is rotated in the second direction and to not engage the tubular when the movable sleeve is rotated in the first direction.

5. The device of claim 1, wherein the plurality of engagement features comprises teeth to grip the tubular when engaged with the tubular.

6. The device of claim 1, wherein the movable sleeve comprises a spline and the sub comprises a groove, the spline configured to slidably engage the groove to allow the movable sleeve to slide axially along the sub.

7. The device of claim 1, wherein at least a subset of the plurality of engagement features comprises a crescent shape.

8. A device for a top drive drilling system comprising:

a movable sleeve configured to be disposed around at least a portion of a sub, the movable sleeve configured to be selectively disposed around a tubular by sliding axially along the sub;

a sealing device configured to provide a seal between the movable sleeve and the tubular, when the movable sleeve is disposed around the tubular; and a plurality of engagement features extending inwardly from an inner circumference of the movable sleeve, wherein, when the movable sleeve is disposed around the tubular, the plurality of engagement features are configured to engage the tubular when the movable sleeve is rotated in a first direction and to not engage the tubular when the movable sleeve is rotated in a second direction.

9. The device of claim 8, wherein the movable sleeve is configured to manually slide along the sub.

10. The device of claim 8, wherein the movable sleeve is configured to receive a control signal to slide along the sub.

11. The device of claim 8, wherein the movable sleeve comprises a spline configured to enable the movable sleeve to slide within a groove of the sub.

12. The device of claim 8, wherein at least a subset of the plurality of engagement features comprises a hinged end configured to allow the subset of the plurality of engagement features to engage or not engage the tubular.

13. The device of claim 8, wherein the plurality of engagement features comprises wickers to grip the tubular when engaged with the tubular.

14. A method for coordinating tubulars in a top drive drilling system comprising:

sliding a movable sleeve axially along a sub and forming a seal between the movable sleeve and the sub via a sealing device;

disposing a plurality of engagement features around a tubular, wherein the plurality of engagement features extend inwardly from an inner circumference of the movable sleeve;

rotating the plurality of engagement features around the tubular in a first direction; and engaging the plurality of engagement features with the tubular to cause the plurality of engagement features to apply a frictional force to the tubular, wherein the frictional force is configured to cause the tubular to rotate in the first direction.

15. The method of claim 14, comprising disengaging the plurality of engagement features from the tubular to cause the plurality of engagement features to discontinue applying the frictional force to the tubular.

16. The method of claim 14, comprising rotating the plurality of engagement features around the tubular in a second direction such that the plurality of engagement features slip past the tubular.

17. The method of claim 16, comprising sliding the movable sleeve axially along the sub to move the plurality of engagement features from being disposed around the tubular.

18. The method of claim 16, comprising sliding the movable sleeve axially along the sub to cause the movable sleeve to not be disposed around the tubular.

* * * * *